US012660864B2

(12) United States Patent
Moyles et al.

(10) Patent No.: US 12,660,864 B2
(45) Date of Patent: Jun. 23, 2026

(54) COOLING UNDERGARMENT

(71) Applicant: Care For There LLC, Carlsbad, CA (US)

(72) Inventors: Thomas Moyles, Carlsbad, CA (US); Jared Moore, Huntersville, NC (US)

(73) Assignee: CARE FOR THERE LLC, Carlsbad, CA (US)

( * ) Notice: Subject to any disclaimer, the term of this patent is extended or adjusted under 35 U.S.C. 154(b) by 0 days.

(21) Appl. No.: 18/632,194

(22) Filed: Apr. 10, 2024

(65) Prior Publication Data

US 2025/0318585 A1 Oct. 16, 2025

Related U.S. Application Data

(60) Provisional application No. 63/444,768, filed on Feb. 10, 2023.

(51) Int. Cl.
*A41B 9/00* (2006.01)

(52) U.S. Cl.
CPC ..... *A41B 9/001* (2013.01); *A41B 9/004* (2013.01); *A41B 2300/20* (2013.01)

(58) Field of Classification Search
CPC ..... A41B 9/001; A41B 9/004
See application file for complete search history.

(56) References Cited

U.S. PATENT DOCUMENTS

| | | | | | |
|---|---|---|---|---|---|
| 2,762,711 | A * | 9/1956 | Zopf, Jr. | G01N 31/222 | 426/231 |
| 4,859,360 | A * | 8/1989 | Suzuki | G01K 11/165 | 374/162 |
| 4,981,135 | A * | 1/1991 | Hardy | A61F 7/02 | 607/108 |
| 5,243,974 | A * | 9/1993 | Allen | A41B 9/02 | 2/403 |
| 6,068,607 | A * | 5/2000 | Palmer | A61F 7/10 | 602/70 |
| 10,085,492 | B2 * | 10/2018 | Polidan | A41B 9/001 | |
| 2008/0060242 | A1 * | 3/2008 | Greer | G09F 19/22 | 40/612 |
| 2008/0229253 | A1 * | 9/2008 | Carteri | G06F 8/34 | 715/854 |
| 2012/0079980 | A1 * | 4/2012 | Taylor | G01K 11/12 | 436/2 |
| 2022/0125615 | A1 * | 4/2022 | Maher | A61B 5/4836 | |

* cited by examiner

*Primary Examiner* — Gloria M Hale
(74) *Attorney, Agent, or Firm* — Womble Bond Dickinson (US) LLP

(57) ABSTRACT

An undergarment is provided which provides for concurrent communication of compression and cold temperature to a surgical area of a vasectomy patient. The undergarment is formed of elastic material which will impart compression when stretched. A holding pocket on a front portion of the undergarment body accepts a removably engageable cooling pack which when positioned within the holding pocket will communicate cold temperatures to the surgical area.

8 Claims, 4 Drawing Sheets

COOLING UNDERGARMENT

This application claims priority to U.S. Provisional Patent Application 63/448,768 filed on Feb. 10, 2023.

BACKGROUND OF THE INVENTION

1. Field of the Invention

The present invention relates to undergarments for men. More particularly, it relates to an elastically biased undergarment for imparting compression and having a compartment configured for concurrent positioning of a cooling pack having a shape configured to follow a curved insertion into the garment compartment to thereby communicate therapeutic cold temperature along a curved positioning over substantially all of the post-vasectomy surgical area.

2. Prior Art

A vasectomy is one of the most common urological procedures performed by urologists worldwide because the procedure is one of the most effective male contraceptive methods. Because of the effectiveness of the procedure, there are an estimated 500,000 vasectomies performed in the United States every year.

Vasectomies are, conventionally, a procedure which is accomplished on an outpatient basis. Subsequent to such a procedure, patients are generally advised to wear a pair of tight-fitting or at least snug underwear. This is to provide extra support to the scrotum area to help minimize post surgery discomfort.

While patients may be provided medication for pain, as a general rule, medical professionals prefer other means for minimizing pain and discomfort. To that end, conventionally, patients may be advised to apply cold or ice packs to the scrotal area for three to ten days or until discomfort subsides. Such cold packs or ice packs are advised also to help reduce swelling which in turn will also help reduce patient discomfort.

The forgoing examples of related art and limitations related therewith are intended to be illustrative and not exclusive, and they do not imply any limitations on the cooling undergarment device herein. Various limitations of the related art will become apparent to those skilled in the art upon a reading and understanding of the specification below and the accompanying drawings.

SUMMARY OF THE INVENTION

The device herein disclosed and described provides a solution to the need for the application of compression to the body of the patient post-vasectomy in combination with the communication of cooling temperature to the surgery area of vasectomy patients. The undergarment provides such needed function through the provision of a garment which can concurrently impart compression to the area of surgery and cold temperature to the surgical area post-surgery. The garment can also be worn to simply impart compression when cooling is not needed.

The body of the garment is formed of elastic material. By elastic material herein is meant woven or knitted textile fabric or non woven fabric which includes an elastic material or yarn such as spandex and similar elastic material in the weave or knit. Further is meant that the elastic material will elongate when stretched in at least two opposing directions and preferably in four opposing directions, and once elongated will bias inward opposite the direction which the garment is stretched outward. This inward bias or retraction of the elastic material acts to provide the desired compression to the surgical area of the user wearing the garment.

The garment in all modes preferably includes a holding pocket. The holding pocket is located on a front of the undergarment in a location where the rear all thereof or a wall of the undergarment, will cover the body of the user in the appropriate areas. Further the positioning on the front wall locates an opening to the holding pocket where it is within the sight line of the user for loading and replacing cooling packs when needed.

This holding pocket is configured in a length, width, and overall shape, to curve downward and between the legs of the user wearing the undergarment. The holding pocket, preferably, has a front wall also formed of elastic woven or knitted fabric or material. The holding pocket is sized for insertion of a cooling pack therein used in combination with the garment. While the holding pocket will accommodate and hold a conventional rectangular gel pack used for the transmission of heat or cold, the gel pack herein provided is preferably shaped with a first portion at a first end thereof, which has inward angled or tapered edges which intersect at a lower point of the gel pak. This tapered shape substantially mirrors the shape of the pocket especially at the lower end thereof.

This shape of the cooling pack provides two desirable functions which were found highly useful during experimentation in building the garment herein. First, the tapering or pointed leading or lower end thereof gives the user a visually discernable ability to determine the correct end of the cooling pack to insert first into the holding pocket. So inserted correctly, the temperature relative indicia adjacent to a rear edge of the holding pocket is then easily viewable by the user during use. This allows the user an easy manner to discern the temperature of the cooling pack by pulling down the front wall of the pocket without having to remove the gel pak or removing the garment.

Additionally, the tapered shape of the first or lower portion of the cooling pack has been found during experimentation with differing cooling pack shapes, to cause the lower end of the cooling pack to automatically curve toward the space between the legs of the user wearing the undergarment. During insertion this tapered shape was found to easily slide into position within the holding pocket and also to automatically curves around between the legs of the user to cover the surgical area without catching on the internal sides of the formed pocket.

Once so positioned, the shape of the cooling pack also makes inserting a new cooling pack much easier since the tapered edges of the first end separate from the side edges of the formed pocket when pulled and allow a first cooling pack to be easily removed and replaced. Further this insertion, removal and replacement is easily accomplished with the tapered cooling pack without the need to remove the undergarment, which is not a desirable thing to do post-surgery.

With respect to the above description, before explaining at least one preferred embodiment of the herein disclosed undergarment with removably engageable cooling packs, in detail, it is to be understood that the invention is not limited in its application to the details of construction and to the arrangement of the components in the following description or illustrated in the drawings.

The invention herein which is disclosed in the most preferred modes thereof, after testing and design, is capable of other embodiments and of being practiced and carried out in equivalent ways which may be discerned by those skilled in the art upon review of this disclosure. Also, it is to be understood that the phraseology and terminology employed herein are for the purpose of description and should not be regarded as limiting.

As such, those skilled in the art will appreciate that the conception upon which this disclosure is based, while disclosed in the preferred modes thereof, may readily be utilized by those skilled in the art subsequent to review of this specification, as a basis for the design of other configurations of the undergarment herein and for carrying out the several purposes of the present disclosed undergarment device. It is important, therefore, that the claims be regarded as including the most preferred mode of the device and its components and equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, unless provided with a different respective definition, the term substantially herein means plus or minus five percent.

It is an object of this invention to provide an undergarment for use by vasectomy patients to be worn after surgery which will communicate compression to the area of the surgery.

It is an additional object of this invention to provide such an undergarment that is configured for removable engagement with a cooling pack to hold it in a compressed position to cover the area of the vasectomy surgery.

It is an additional object of this invention to provide a cooling pack for use in combination with the undergarment, which is shaped for easy insertion and removal from the garment without the need to remove the garment itself from the body of the user.

It is a further object of this invention to provide an undergarment configured for engagement of a tapered cooling pack therein where the shape of the cooling pack will cause it to automatically curve on insertion and to thereby automatically position itself correctly.

These and other objects of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some but not the only or exclusive examples of embodiments and/or features of the undergarment herein. It is intended that the embodiments and figures disclosed herein are to be considered illustrative rather than limiting.

DETAILED DESCRIPTION OF THE PREFERRED EMBODIMENTS OF THE INVENTION

Figure 1:
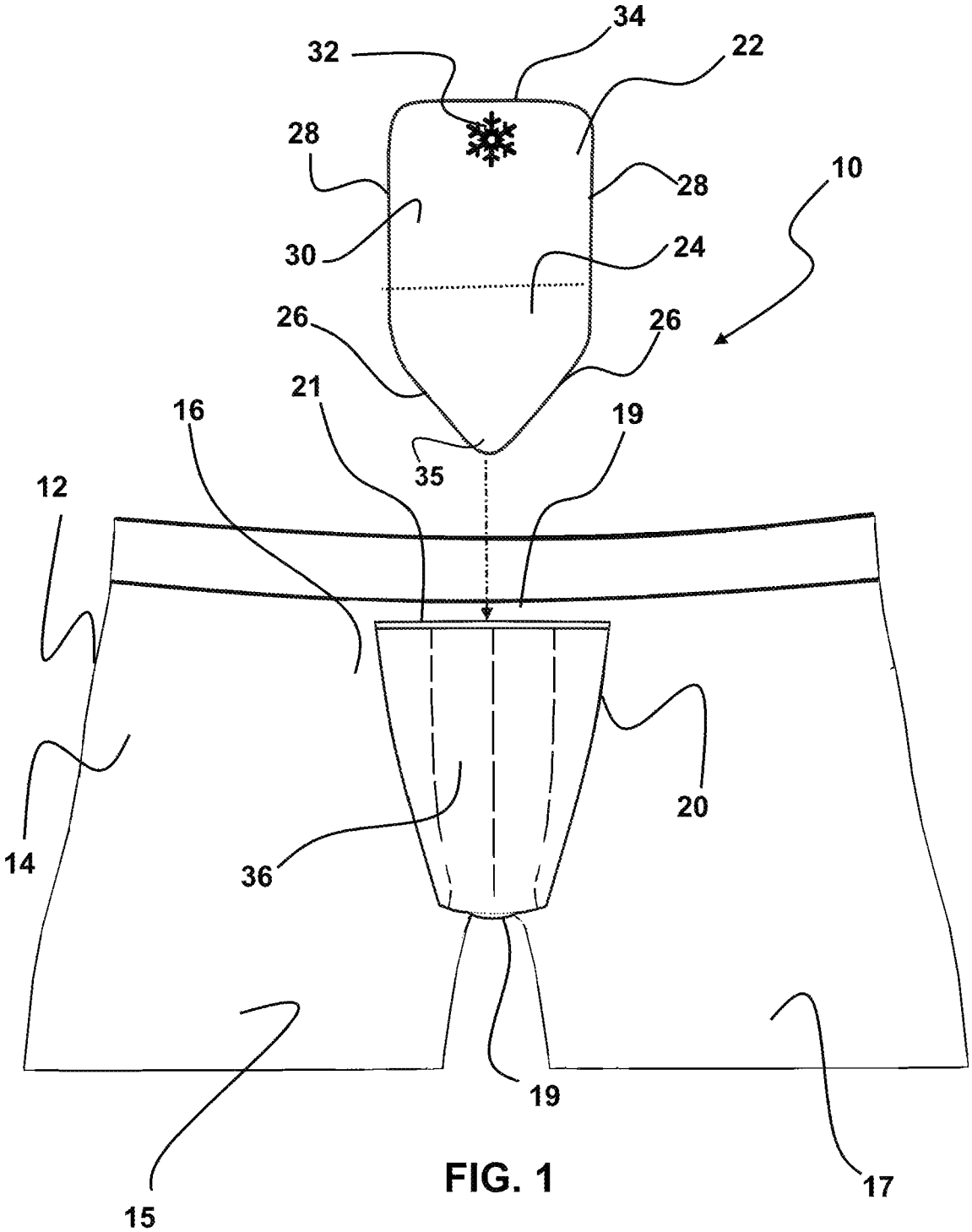
FIG. 1 depicts the device herein showing an exploded view of the undergarment device configured for imparting compression against and cooling to, the surgical area of a vasectomy and showing a preferred tapered cooling pack for insertion into a formed holding pocket.

In this description, the directional prepositions of up, upwardly, down, downwardly, front, back, top, upper, bottom, lower, left, right and other such terms refer to the underwear garment device as it is oriented and appears in the drawings and are used for convenience only. They are not intended to be limiting or to imply that the device or engagements thereto have to be used or positioned in any particular orientation.

Now referring to drawings in FIGS. 1-5, wherein similar components are identified by like reference numerals, there is seen in FIG. 1 a depiction of the front side of the device 10 herein in an exploded view thereof. Shown is the undergarment 12 which is configured with elastic material to allow the body 14 of the undergarment to stretch and retract to provide biased compressive contact as it is positioned on the user or patient.

Figure 4:
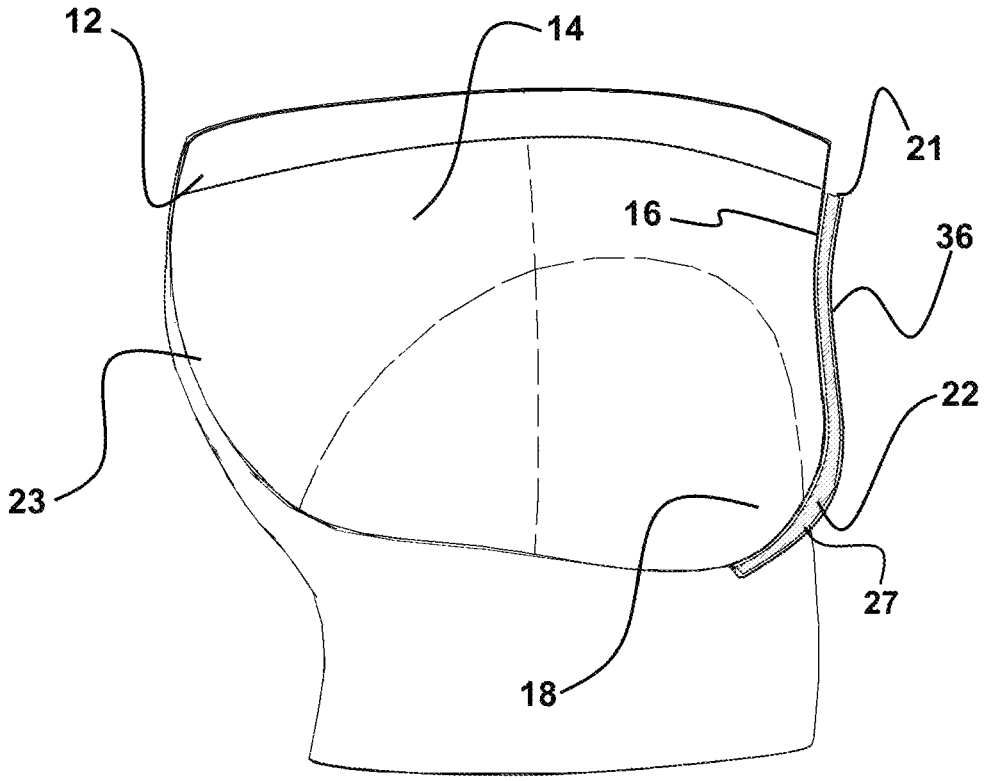
FIG. 4 depicts a sectional view showing the undergarment, as in FIG. 3, with a cooling pack inserted into the interior cavity of the holding pocket where it automatically curves and maintains shape on insertion.

The material forming the body 14 of the undergarment 12, thus, will stretch as it is positioned on the body of the user or patient. This is preferred in order that a portion of the body 14 forming the front wall 16 thereof continuously communicates compression to the surgical area 18, such as is shown in FIG. 4. By surgical areas 18 is meant the scrotum area of the user or patient generally located in the front of the body and extending between the legs of the patient and areas of the skin proximal thereto.

The body 14 of the undergarment, in the form of briefs, includes a front wall 16 and includes a first leg portion 15 and a second leg portion 17 configured for insertion of the legs of the user therethrough to an as-worn position. A central area 19 of the body 14 extends down the front wall 16 and into a lower area in-between the first leg portion 15 and second leg portion 17 and continues in between the two leg portions to an intersection with a rear panel 23 (FIG. 2) of the body 14 of the undergarment 12.

Shown, engaged to the central area 19 of the front wall 16 of the body 14 of the undergarment 14, is a holding pocket 20 positioned on the front wall 16. The holding pocket 20 has a pocket front wall 36 extending to a pocket opening 21 at an upper end and where the pocket front wall 36 is also formed, preferably, of elastic fabric like the body 14. The pocket front wall 36 and the interior cavity 27 of the pocket defined by it, tapers to a narrower area of the pocket and interior cavity 27 which curves between the two leg portions, as shown in FIG. 4. A rear wall of the holding pocket 20 may be a portion of the body 14 such as the front wall 16 and a portion of the body 14 in the central area 19 of the undergarment 12. Alternatively, the holding pocket 20 may be formed with its own rear wall of elastic material which is engaged to the front wall 16 of the body 14. Where employed with the tapering cooling pack 22, a tapering or narrowing of the shape of the holding pocket 20 at the lower end thereof toward and including where it covers the central area 19 is preferable. This tapering at the lower end of the holding pocket 20 was found to better urge the first portion 24 of the cooling pack 22 to curve automatically during insertion and thereby position a portion thereof over the surgical area in the central area 19.

Also depicted is the cooling pack 22 which is removably positionable within the holding pocket 20. Such allows the user to employ a plurality of such cooling packs 22 whereby while one cooling pack 22 is operatively positioned in the holding pocket 20, the others may be cooling in a refrigerated device, such as refrigerator or freezer.

As shown, the tapering shape of the first portion 24 of the cooling pack 22 is preferred as in experimenting it was found that having a first portion 24 of the cooling pack 22 which is tapered between the side edges 26 extending inward to a point at the front end 35 of the cooling pack 22 rendered the cooling pack 22 more easily inserted into the holding pocket 20. This taper, as can be seen, forms a pointed end at said front end 35. The taper also defines an insertion direction for the user which is preferred in order that the indicia 32 is properly positioned for viewing for current temperature of the cooling pack 22.

Further, as already noted, it was found in experimentation that by forming the taper with the two side edges 26 on either side of the first portion 24 of the cooling pack 22, in a length that is equal to or slightly longer than the length of the side edges 28 on opposing sides of a second portion of the cooling pack 22, that the first portion 24 and areas of the second portion 20 will automatically curve during insertion into the holding pocket 20. The higher weight or mass of the upper end of the cooling pack above the shorter and tapering lower end, was found to help push the first portion 24 to form the curve when inserted. This is most important in that the automatic curve wraps the area of the first portion 24 in between the side edges 26 thereof and an area of the second portion 30, adjacent thereto, around the scrotum of the user wearing the undergarment 12. Other shapes of the first portion 24 did not afford this function.

Also shown is indicia 32 positioned adjacent the second end of the cooling pack 22. This indicia is preferably formed with thermochromic ink or the like which changes color relative to temperature. The indicia 32 will, thus, have a first color which will indicate the cooling pack 22 is of a colder temperature, such as 25-45 degrees Fahrenheit, and have a second color which will show when the cooling pack 22 has reached a non-therapeutic temperature, such as above 45 degrees Fahrenheit.

This indicia 32 is placed on a side surface of the cooling pack 22 at a point abutting the rear edge 34 of the cooling pack 22. This is preferred, because it allows the user to view the indicia 32 and current temperature of the cooling pack 22 without removing it from the holding pocket 20. The user can just pull downward on the pocket front wall 36 of the holding pocket 20 and the indicia 32 adjacent the rear edge 34 will be visible.

Figure 2:
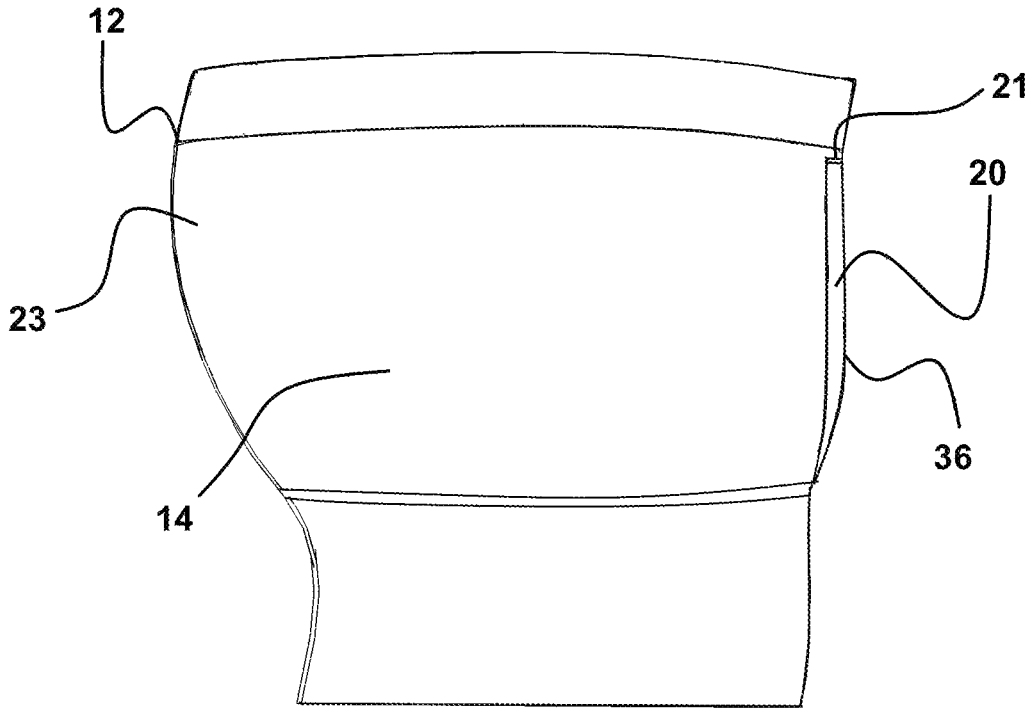
FIG. 2 shows a side view of the device in an as-used positioning upon a patient or user.
Figure 3:
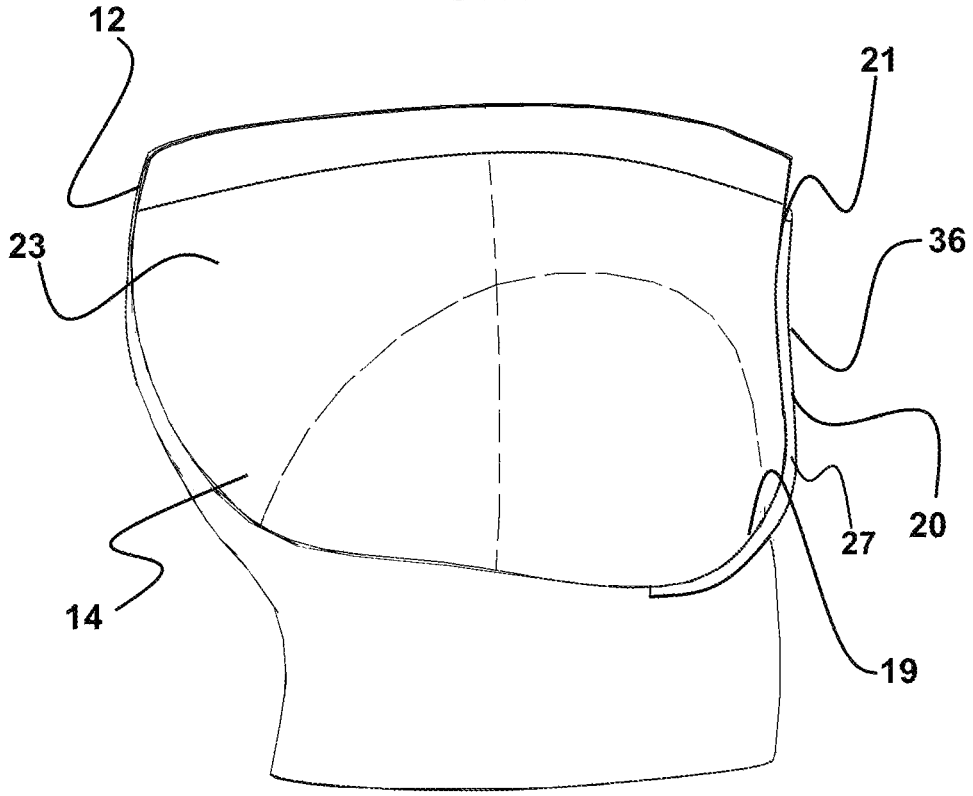
FIG. 3 depicts a sectional view of the device of FIGS. 1 and 2 showing the curved compressive holding pocket having a bottom or lower end thereof positioned on the central area of the body in-between the first leg portion and second leg portion to impart compression from the garment and cooling from an inserted cooling pack to the surgical area.

The undergarment 12 is shown in FIG. 2 in a side view of the device 10 herein in an as-used positioning of the undergarment 12. As shown, the body 14 of the elastic fabric undergarment is stretched and imparts compression against the body of the user. The holding pocket 20 is properly located to curve around, as in FIG. 4, and impart compression from the elastic material forming the body 14 and the pocket front wall 36 of the holding pocket 20 against the surgical area 18 (FIG. 4) of the user which in this case is curving around the scrotum. A sectional view of the undergarment 12 and the body 14 in this as-used positioning on a user or patient is shown in FIG. 3 and FIG. 4. In FIG. 3 is shown the undergarment 12 with the body 14 stretched and contacting against the user in a biased contact. The holding pocket 20 is empty which is how the device 10 may be employed in time periods where the cooling pack 22 is not needed.

However, without removing the undergarment 12 from this as-used positioning, the user can easily insert the cooling pack 22 using the tapered first portion 24 as a visual guide for the correct insertion direction to achieve both the curved positioning of the cooling pack, shown in FIG. 4, and the proper positioning of the indicia 32. With the cooling pack 22 inserted into the holding pocket 20, as in FIG. 4, the user can easily pull the pocket front wall 36 of the holding pocket 20 downward or toward their feet, if standing, and view if the temperature of the cooling pack 22 is of a therapeutic level.

Additionally, as noted, the taper formed by the two side edges 26 of the first portion 24 of the cooling pack 20 also causes the cooling pack 22 to easily slide into the holding pocket 20 even with the compression of the elastic material forming the pocket front wall 36 imparting pressure against it. Still further, the cooling pack 22 will automatically curve around and into the scrotum or surgical areas 18 of the user while wearing the undergarment 12 in this as-used position, thereby eliminating the need to remove it to insert cooling packs 22 to curve into positions to communicate cold to the surgical area 18.

As is well known, subsequent to a vasectomy, removal and replacement of garments covering or contacting the surgical area 18 can at a minimum be uncomfortable and in many cases extremely painful. Thus, the formation of the device 10 to include both the communication of compression and cooling to the surgical area 18, where the cooling pack 22 can be removed when not needed and replaced as needed without removing or adjusting the position of the undergarment 12 body 14, is highly preferred.

Figure 5:
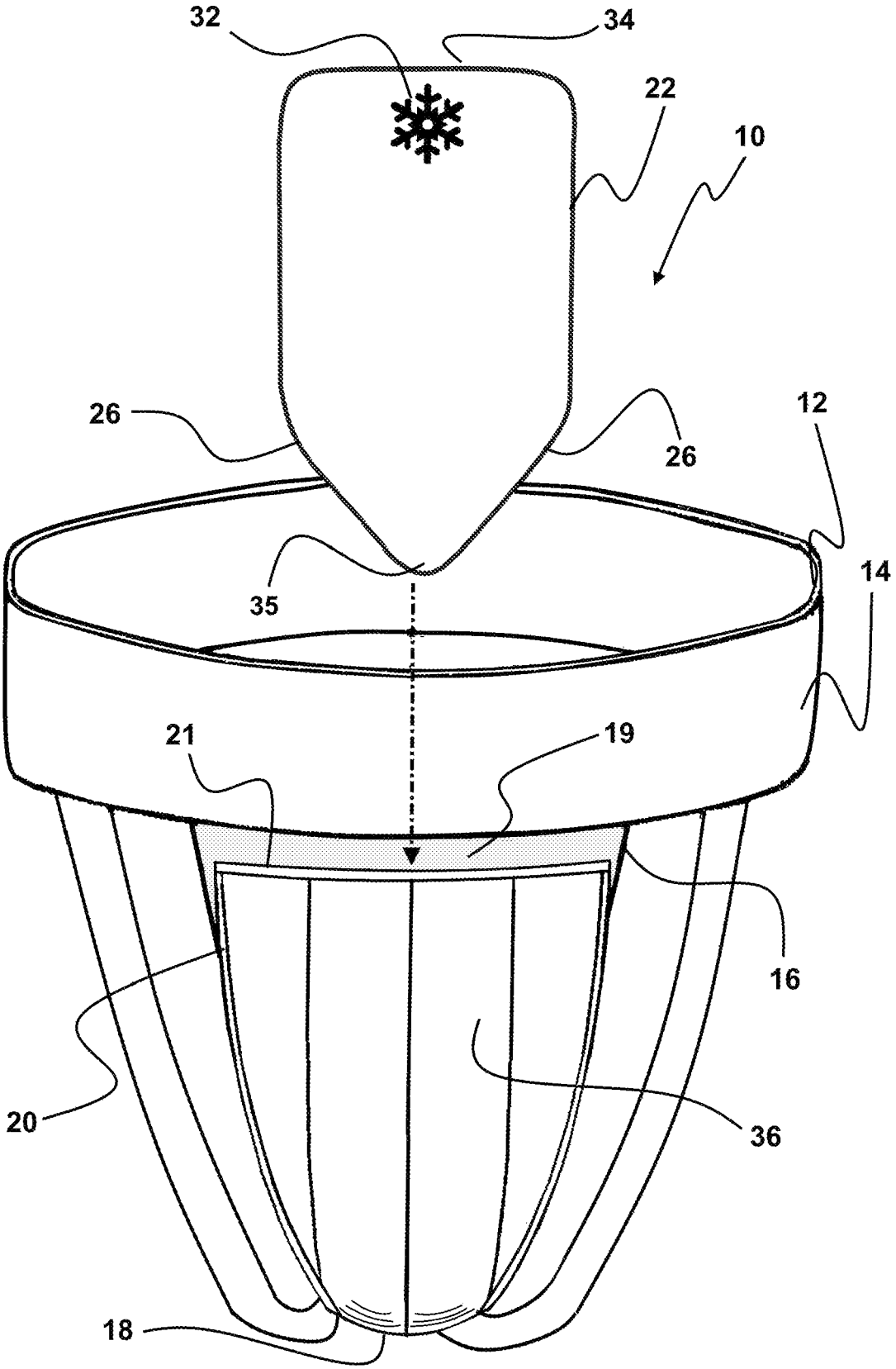
FIG. 5 depicts a mode of the device herein in which the holding pocket is positioned upon a front wall of the undergarment thereof and has a portion thereof which curves to a position between the two legs of the user and adjacent the surgical area.

Shown in FIG. 5 is a mode of the device 10 herein where the undergarment 12 is formed similar to an athletic supporter. This mode functions the same as that of FIGS. 1-4 in that the body 14 has a front wall 16 which curves at the lower end thereof toward the rear of the undergarment 15 and between the legs of the user. As shown, the holding pocket 20 is positioned upon a front wall 16 of the body thereof and curves to a position between the two legs of the user and under the surgical area 18.

This mode of the device 10 functions substantially the same as the other modes in that it is configured with a front wall 16 of elastic material which has a central area 19 which curves rearward at a lower end and is engaged to straps and thereby provides compression to the surgical area 18. The cooling pack 22, with the taper formed by the two side edges 26 of the first portion 24 thereof, will easily slide into and out of the holding pocket 20 and will curve therein during insertion to cover the surgical area 18 within the area of the holding pocket 20 which curves to cover that position.

Like the other versions of the device 10 herein, the cooling pack 22 is insertable and removable without removing the garment, and the user can easily check on the current temperature thereof by viewing the color of the indicia 32 by simply pulling downward on the elastic material forming the pocket front wall 36 of the holding pocket 20.

While all of the fundamental characteristics and features of the underwear garment device configured for the communication concurrently of compression and cooling to the surgical area of a vasectomy patient have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions of components for equivalent components and modifications variations may be made by those skilled in the art without departing from the spirit of the invention.

What is claimed is:

1. An undergarment apparatus for concurrent communication of compression and cold temperature to a surgical area of a vasectomy patient comprising:

an undergarment having a body formed of elastic material, said body configured with a front wall and a first leg portion for insertion of a first leg of a user therethrough and a second leg portion for insertion of a second leg of said user therethrough;

a holding pocket positioned on said front wall, said holding pocket having an interior cavity positioned between a pocket front wall and said front wall of said body;

a pocket opening at an upper end of said holding pocket;

said interior cavity of said holding pocket extending from said upper end to a lower end thereof and located between said first leg portion and said second leg portion; and a cooling pack, said cooling pack for positioning into said interior cavity of said holding pocket whereby a cool temperature from said cooling pack is configured to be communicated to the body of a user of said undergarment wearing it in an as-worn position;

indicia positioned upon said cooling pack, said indicia formed of temperature sensitive ink;

said indicia having a first color which indicates a temperature of said cooling pack is of a colder temperature between 25-45 degrees Fahrenheit; and said indicia having a second color indicating the cooling pack has reached a non-therapeutic temperature above 45 degrees Fahrenheit.

2. The undergarment apparatus of claim 1, additionally comprising:

said cooling pack having a first portion and a second portion thereof;

said first portion having tapering between two angled side edges thereof, from a wider area thereof adjacent said second portion to a pointed end of said first portion; and said angled side edges during sliding contact with sides of said interior cavity, curving said first portion into said lower end of said interior cavity during insertion of said cooing pack through said pocket opening and into said interior cavity.

3. The undergarment apparatus of claim 2, additionally comprising:

said interior cavity of said holding pocket tapering from a widest portion thereof at said pocket opening to a narrowest portion thereof at said lower end of said interior cavity.

4. An undergarment apparatus for concurrent communication of compression and cold temperature to a surgical area of a vasectomy patient comprising:

an undergarment having a body formed of elastic material, said body configured with a front wall and a first leg portion for insertion of a first leg of a user therethrough and a second leg portion for insertion of a second leg of said user therethrough;

a holding pocket positioned on said front wall, said holding pocket having an interior cavity positioned between a pocket front wall and said front wall of said body;

a pocket opening at an upper end of said holding pocket;

said interior cavity of said holding pocket extending from said upper end to a lower end thereof and located between said first leg portion and said second leg portion; and a cooling pack, said cooling pack for positioning into said interior cavity of said holding pocket whereby a cool temperature from said cooling pack is configured to be communicated to the body of a user of said undergarment wearing it in an as-worn position;

said cooling pack having a first portion and a second portion thereof;

said first portion having tapering between two angled side edges thereof, from a wider area thereof adjacent said second portion to a pointed end of said first portion; and said angled side edges during sliding contact with sides of said interior cavity, curving said first portion into said lower end of said interior cavity during insertion of said cooling pack through said pocket opening and into said interior cavity;

said second portion of said cooling pack positioned between substantially parallel second portion sidewalls;

said second portion sidewalls having a first length extending from a rear edge of said cooling pack to said first portion thereof;

said sidewalls having a second length extending from respective intersections with said second portion sidewalls to said pointed end; and said first length being longer than said second length.

5. The undergarment apparatus of claim 4, additionally comprising:

said interior cavity of said holding pocket tapering from a widest portion thereof at said pocket opening to a narrowest portion thereof at said lower end of said interior cavity.

6. The undergarment apparatus of claim 2, additionally comprising:

said second portion of said cooling pack positioned between substantially parallel second portion sidewalls;

said second portion sidewalls having a first length extending from a rear edge of said cooling pack to said first portion thereof;

said sidewalls having a second length extending from respective intersections with said second portion sidewalls to said pointed end; and said first length being longer than said second length.

7. The undergarment apparatus of claim 3, additionally comprising:

said second portion of said cooling pack positioned between substantially parallel second portion sidewalls;

said second portion sidewalls having a first length extending from a rear edge of said cooling pack to said first portion thereof;

said angled sidewalls having a second length extending from respective intersections with said second portion sidewalls to said pointed end; and said first length being longer than said second length.

8. An undergarment apparatus for concurrent communication of compression and cold temperature to a surgical area of a vasectomy patient comprising:

an undergarment having a body formed of elastic material, said body configured with a front wall and a first leg portion for insertion of a first leg of a user therethrough and a second leg portion for insertion of a second leg of said user therethrough;

a holding pocket positioned on said front wall, said holding pocket having an interior cavity positioned between a pocket front wall and said front wall of said body;

a pocket opening at an upper end of said holding pocket;

said interior cavity of said holding pocket extending from said upper end to a lower end thereof and located between said first leg portion and said second leg portion, and said interior cavity of said holding pocket further tapering from a widest portion thereof at said pocket opening to a narrowest portion thereof at said lower end of said interior cavity; and a cooling pack, said cooling pack for positioning into said interior cavity of said holding pocket whereby a cool temperature from said cooling pack is configured to be communicated to the body of a user of said undergarment wearing it in an as-worn position;

indicia positioned upon said cooling pack, said indicia formed of temperature sensitive ink;

said indicia having a first color which indicates a temperature of said cooling pack is of a colder temperature between 25-45 degrees Fahrenheit; and said indicia having a second color indicating the cooling pack has reached a non-therapeutic temperature above 45 degrees Fahrenheit.

* * * * *